US005259149A

United States Patent [19]

Klievoneit et al.

[11] Patent Number: 5,259,149

[45] Date of Patent: Nov. 9, 1993

[54] DICING BLADE HUB AND METHOD

[75] Inventors: Harold R. Klievoneit, Mesa; Augustine G. Esposito, Phoenix; Robert C. Runyon, Sun City West, all of Ariz.

[73] Assignee: St. Florian Company, Phoenix, Ariz.

[21] Appl. No.: 809,887

[22] Filed: Dec. 18, 1991

[51] Int. Cl.[5] ..... B24B 1/00

[52] U.S. Cl. ..... 51/281 SF; 51/5 C; 51/326

[58] Field of Search ..... 51/281 R, 281 SF, 326, 51/5 C; 76/115

[56] References Cited

U.S. PATENT DOCUMENTS

| | | | |
|---|---|---|---|
| 3,601,932 | 8/1971 | Elliott et al. | 51/281 R |
| 3,691,707 | 9/1972 | Von Arx et al. | 51/206 R |
| 4,586,296 | 5/1986 | Saunders | 51/281 SF |

*Primary Examiner*—M. Rachoba

*Attorney, Agent, or Firm*—Cahill, Sutton & Thomas

[57] ABSTRACT

Apparatus and a method are disclosed for grinding opposed faces of the hub of a dicing blade flat and parallel while preserving the capability of electroplating the hub with a membrane. Apparatus and a method are also disclosed for obtaining a single or dual rectilinear or curvilinear radial taper of the dicing blade.

7 Claims, 3 Drawing Sheets

DICING BLADE HUB AND METHOD

BACKGROUND OF THE INVENTION

1. Field of the Invention

The present invention relates to dicing blade hubs for dicing saws and, more particularly, to precision ground dicing blade hubs and method for making same.

2. Background of Related Art

High speed circular hub mounted dicing blades have been used for decades to cut wafers into pieces or die for subsequent fabrication into various semiconductor devices. A typical dicing saw blade is illustrated and described in U.S. Pat. No. 3,691,707.

The dicing saw blade is typically made by turning the aluminum hub of the saw on a high precision lathe. The aluminum hub is gripped in a chuck of some sort and a tool, usually diamond or carbide tipped, is used to remove the excess material and to produce the finished part. This process is both relatively cheap and fast and has been virtually unchanged for 20 years. After the hub has been turned, it is plated on one radial surface with a nickel and diamond grit composition to form a thin membrane of nickel bonded diamond grit which will actually become the dicing blade. This membrane is typically 0.0006–0.004 inches in thickness. To convert the membrane into the dicing blade, part of the aluminum hub is removed by a lathe and a thin aluminum film is left adjacent the membrane. This thin aluminum film is etched away to leave the nickel and diamond grit membrane exposed as the dicing blade. When the membrane is free standing, it is very fragile. The dicing saw blade is now ready to use to dice silicon wafers.

In practice, the dicing blade cuts through the wafer at a rotational speed of about 30,000 rpm. Because the hub surface supporting the dicing blade is not very flat due to the method of manufacture, the dicing blade flexes or wobbles in its rotational orbit. Actual measurements of turned hub surfaces show that the flatness deviation is in the range of 100 to 500 micro inches. Proof of this wobble is evident in the kerf (cutting path) generated by the dicing blade; for example, a 0.002 inch wide blade may create a 0.003 inch wide kerf because of the wobble and related lateral deflection. At a rotational speed of 30,000 rpm, there is a mechanical stress on the edge of the dicing blade. However minuscule the wobble, the rate of flexing is 500 times per second and each valley becomes a potential stress riser. Over a period of time, the flexing causes fatigue along the weakest stress riser and the dicing blade will break. This is one of the major causes for dicing blade failure, particularly during early stages of use. When such failure occurs, it is not unusual to ruin the wafer being cut. The costs attendant with such ruined wafers relate to die loss, the cost of production to date along with lost time associated with replacement of the dicing saw blade and the new wafer.

This method of production inherently has two problems which limit the life of the dicing saw blade. One problem arises because the lathe or turning process typically leaves behind turning marks that manifest themselves on the side of the aluminum hub upon which the dicing blade will be formed. Thus, one side of the dicing blade is rough due to the marks left by the lathe. It is well known in the mechanical art that roughness, grooves, notches or scratches in a piece of material act as stress risers and cause that material to suffer fatigue cracking when stressed and flexed many times. This leads to the second problem which is one of flatness and parallelism of the hub. Although a lathe may be able to turn a part flat while it is held in the chuck, as soon as the part is released from the chuck, the part distorts because of the pressures previously exerted upon it by the chuck jaws. Therefore, it is almost impossible to produce the hub on a lathe to the flatness and parallelism required to prevent wobble during the wafer sawing or cutting process. Rapid flexing of the blade will occur due to the wobble as the wafer is cut. The turning marks on the side of the dicing blade act as notches to accelerate fatigue cracking and bring about a premature failure of the dicing blade.

The traditional lapping method uses flat metal plates set on a rotating table onto which the parts are placed in holders or carriers. As the lapping table rotates, the parts are held in place within a fixed rotating well or truing plate. A slurry, a mixture of coolant and aluminum oxide or diamond grit, flows onto the rotating metal table and laps the parts flat. However, during the lapping process, the grit in the slurry becomes embedded in the part. The embedded grit renders the hub difficult, if not impossible to nickel plate and therefore it is difficult to form the dicing blade on the aluminum hub.

BRIEF DESCRIPTION OF THE DRAWINGS

The present invention will be described with greater specificity and clarity with reference to the following drawings, in which.

SUMMARY OF THE INVENTION

Prior to plating of a dicing blade upon an aluminum hub, the aluminum hub is ground between a fixed abrasive grinding wheel and a backing plate. The fixed abrasive grinding wheel is formed by mixing an appropriate abrasive grit with a suitable resin. The mixture is molded into a table section bonded to a thick rigid backing plate. The table section is turned on a lathe to achieve a flat true grinding surface. The resulting composite is mounted on a lapping machine. A clear oil or a water based coolant is used instead of a slurry during grinding. Thereafter, the hub is turned over and placed between a backing plate and the grinding surface to grind the other side. The hub thereby produced has a flatness and parallelism unmatched by conventional techniques and produces a hub which can be nickel plated. After the dicing blade is plated onto the hub, is it ground or lapped with a spherically concave surface to taper one side. Thereafter, an annular segment of the hub is cut and etched away to expose the opposed side of the dicing blade. To obtain a dual taper of the dicing blade, the hub may be ground with a spherically convex grinding wheel prior to plating of the dicing blade thereon in order to achieve a slope on the hub side of the dicing blade prior to tapering the exposed side.

It is therefore a primary object of the present invention to provide a hub for a dicing blade which has opposed sides with a high degree of flatness and parallelism.

Another object of the present invention is to provide apparatus for preparing a hub prior to plating of the dicing blade.

Yet another object of the present invention is to provide apparatus for radially tapering one surface of the dicing blade.

Still another object of the present invention is to provide apparatus for tapering both sides of the dicing blade.

A further object of the present invention is to provide a radially tapered dicing blade of a dicing saw blade having greater strength than an equivalent perimeter thickness untapered dicing blade.

A still further object of the present invention is to increase the strength of a dicing blade at the expected location of failure.

A yet further object of the present invention is to provide a method for improving the flatness and parallelism of opposed sides of the hub of the dicing saw blade.

A yet further object of the present invention is to provide a method for tapering the dicing blade.

These and other objects of the present invention will become apparent to those skilled in the art as the description thereof proceeds.

DESCRIPTION OF THE PREFERRED EMBODIMENT

Figure 1:
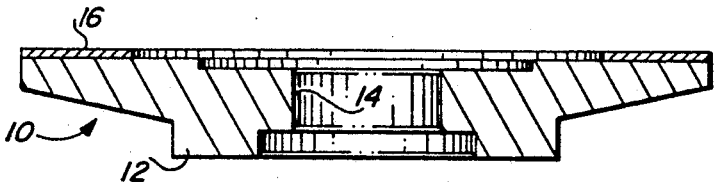
FIGS. 1, 2 and 3 illustrate conventional preparation of the hub of a dicing saw blade.
Figure 2:
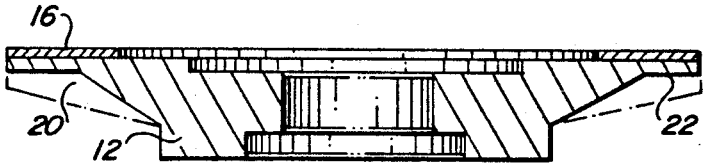
Figure 3:
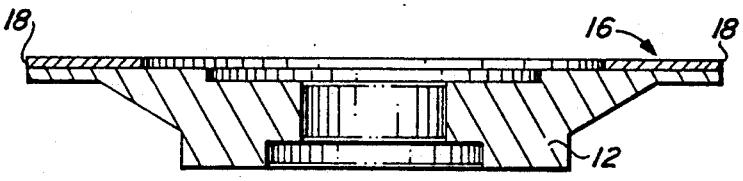

A dicing saw blade used to dice wafers or substrates for the semiconductor industry includes a spindle mountable aluminum hub supporting a radially extending dicing blade. FIGS. 1 to 5 illustrate presently available dicing saw blades 10 and the various components thereof. More particularly, the dicing saw blade includes aluminum hub 12 having a bore 14 for receiving a spindle upon which the dicing saw blade is mounted. Dicing blade 16 may be thought of as a film or membrane of nickel and diamond or other abrasive grit electro-plated along a radially oriented annular band. In the configuration of the dicing saw blade illustrated in FIG. 1, the hub has been turned on a lathe to form its general dimensions and the dicing blade has been electro-plated thereon. Thereafter, the steps illustrated in FIGS. 2 and 3 are performed to expose the dicing blade into an operable configuration.

As shown in FIG. 2, after electro-plating of dicing blade 16 upon hub 12, annular portion 20 of the hub is removed by turning the hub on a lathe. Because of the relative crudeness of a lathe and to protect dicing blade 16, a thin wall 22 adjacent the dicing blade is left. By well known etching techniques, wall 22 is etched away to leave annular segment 18 of dicing blade 16 exposed on opposed sides, as illustrated in FIG. 3. The dicing saw blade may now be mounted upon a spindle ready for use in cutting or dicing wafers.

Figure 4:
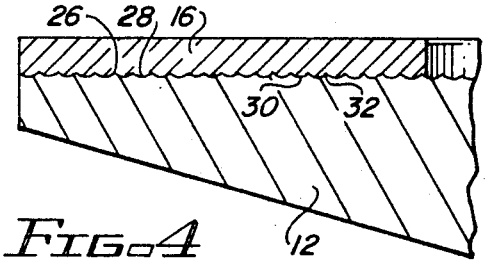
FIGS. 4 and 5 illustrate in partial cross-sectional views the configuration of the surface of the dicing blade adjacent the hub of a conventional dicing saw blade.
Figure 5:
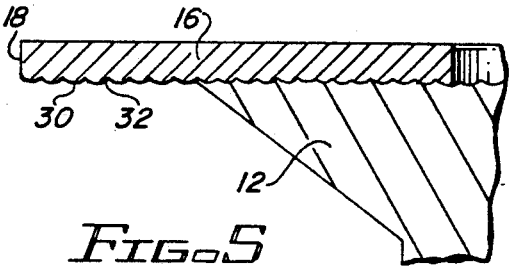

Aluminum hub 12 is manufactured on a production lathe (usually a CNC). The condition of the lathe spindle, the cross-slide, the type of cutting tool used and, more importantly, how the hub is fixtured on the holding chuck, will dictate the overall flatness and surface finish of hub. All lathe turned hubs have a helical form of cut and under magnification show a pattern of hills 26 and valleys 28, as depicted in FIG. 4. Each valley is a potential stress riser since the valley is thinner than the hill next to it. This valley and hill pattern is carried through to dicing blade 16 resulting in formation of hills 30 and valleys 32 therein, as depicted in FIG. 5. Even the best surface finish obtained by using a natural diamond cutting tool with a low feed rate and a small cut produces hills and valleys.

The dicing blade, cutting through the silicon wafer, is rotating at 30,000 rpm. Because the dicing blade is not very flat due to the current method of manufacture of the hub, the dicing blade flexes or wobbles in its rotational orbit. Actual measurements of turned hub surfaces show that the flatness deviation runs from 100 to 500 micro inches. Proof of this wobble is evident in the kerf (cutting path) generated by the dicing blade. For example, a 0.002 inch wide blade may create up to a 0.003 inch wide kerf. Rotation of dicing blade 16 at 30,000 rpm produces mechanical stress at cutting edge 18. However minuscule the wobble, the rate of flexing is 500 times per second and each valley becomes a potential stress riser. Over a period of time, the flexing causes metal fatigue along the weakest stress riser and the dicing blade will break. This is one of the major reasons for blade failure, particularly early blade failure. Furthermore, such failure predominately occurs at the outer most support point 30 (see FIG. 5) or the junction between the dicing blade and the hub.

Figure 6:
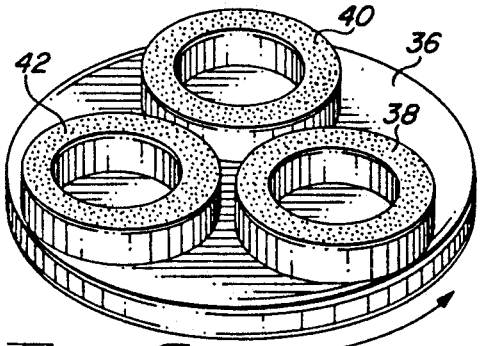
FIG. 6 illustrates a representative conventional lapping machine to be used in preparing the surface of a grinding table.

Normally, a standard lapping machine is employed to produce very flat and parallel surfaces. There are two types of such machines, single sided and double sided. The single sided machine consists of a flat round table 36 supporting several truing rings 38, 40 and 42 as shown in FIG. 6. The truing rings keep the table flat, contain the parts being lapped and distribute slurry evenly over the table. In this type of machine, the material is removed from the part being lapped by a free abrasive slurry dribbled slowly onto the table. In a double side lapping machine, a second table rotates on top of the parts being lapped so both sides are lapped simultaneously. Such a standard free abrasive lapping technique is not suitable for the hub of a dicing saw blade because the method produces a surface that becomes a sponge composed of metal and grit. Such a surface creates a great deal of difficulty in forming the dicing blade on the hub by a plating process. To overcome this deficiency attendant standard lapping machines, a modified machine has been developed.

Figure 7:
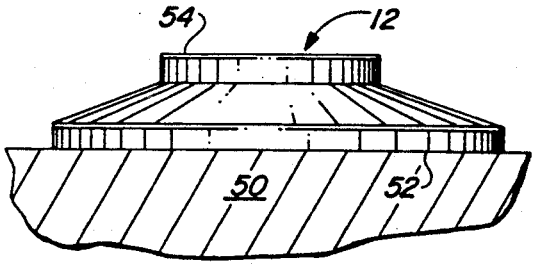
FIG. 7 illustrates grinding of one side of the hub of a dicing saw blade.

As illustrated in FIG. 7, a lapping machine has been converted into a grinding machine by replacing the lapping table with a fixed abrasive grinding table 50. The grinding table consists of an abrasive grain, aluminum oxide, silicon carbide or other grit bonded with a resin, such as a rigid polyurethane foam. Grinding table 50 is produced by mixing the selected grit with the resin and a hardening agent. The mixture may also contain other components to achieve desirable characteristics. The resulting batch is molded into a grinding table under heat and pressure sufficient to produce the desired configuration and characteristics. The grinding table is bonded to a thick, rigid backing plate and turned on a lathe to achieve a flat true grinding surface. The grinding table may then be mounted upon a conventional lapping machine. The lapping machine is operated in the conventional manner except that a clear oil or water based coolant is used instead of an abrasive slurry.

In operation, hub 13 is placed upon grinding table 50 with face 52 to be plated in contact with the grinding table, as illustrated in FIG. 7. The hub or hubs, if a multitude of hubs are to be ground simultaneously, are retained within appropriate fixtures to hold them in place. The hubs are ground under only their own weight. The grinding continues until sufficient material is removed to produce a surface which has been ground to remove most if not all high spots. Thereafter, hub(s) 12 is turned over and back side 54 is ground after placing a very flat backing plate 56 upon surface 52 of hub 12. Surface 58 of backing plate 56 is aligned and maintained parallel with grinding surface 60 of grinding table 50. By pressing down on hub 12 with backing plate 56, particularly when a plurality of hubs 12 are ground simultaneously, back surface 54 of the hub(s) are ground not only flat but also parallel to face 52 of each of the hubs. In the third and final step, the hub(s) is turned over to provide a final grinding to face 52. Because surface 54 of hub(s) 12 is very flat commensurate with surface 58 of backing plate 56 and as the surface of the backing plate is parallel with grinding surface 60 of grinding table 50, face 52 will be ground flat and parallel with back surface 54. Each of the hubs ground is now ready to be plated with a conventional nickel diamond composition or other selected composition to form dicing blade 16.

This grinding process produces a hub which is extremely flat and parallel. Measurements and tests indicate that flatness across face 52 of the hub is within 20 micro inches. Additionally, this grinding process produces a very fine smooth finish when the appropriate grit is used. Such a hub will rotate far more true an thus substantially reduces flexing of the dicing blade. Since the turning marks producing stress risers no longer exist, the cause for fatigue cracking and early failure of dicing blade 16 has been removed.

Figure 8:
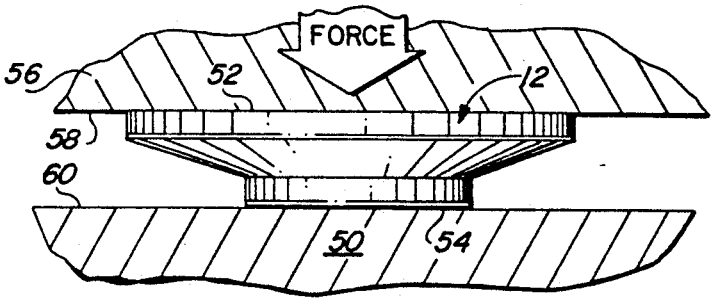
FIG. 8 illustrates the grinding of another sides of the hub of a dicing saw blade.
Figure 9:
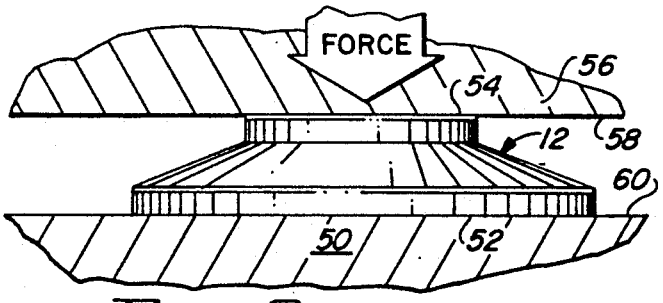
FIG. 9 illustrates final grinding of the first side of the hub of a dicing saw blade.
Figure 10:
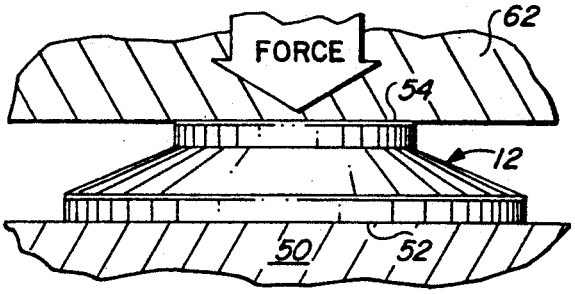
FIG. 10 illustrates simultaneous grinding of opposed sides of the hub of a dicing saw blade.

To speed up the grinding of opposed surfaces of a hub, the backing plate illustrated in FIGS. 7, 8 and 9 may be replaced by an upper grinding table 62, as illustrated in FIG. 10. With both lower grinding table 50 and upper grinding table 62 having parallel opposed sides and hub(s) 12 being retained therebetween, face 52 and back surface 54 may be ground simultaneously. Furthermore, the faces and the back surfaces of the hubs will be ground parallel with one another to achieve the same results with the same degree of accuracy available from the procedure described with reference to FIGS. 7, 8 and 9.

As illustrated in FIG. 10, dicing blade 16 includes a free standing segment 70, cutting edge 18 doing the actual cutting of the wafer. Furthermore, it is actually a cantilevered beam. The mathematical formula for calculating the strength of a cantilevered beam is $P = Sbh^2/6L$, where P = load in pounds, S = safe stress in pounds per square inch, L = length, b = width and h = height. If one compares two dicing blades which are identical except that one has a tapered section 70, all factors except thickness (h) cancel out and the improvement in strength is a function of $h_1^2 + h_2^2$. Thus, if one compares a blade which is 0.0012 inches thick and having uniform cross-section against a blade which is 0.0012 inches thick at cutting edge 18 but 0.0015 inches thick at junction 30 the improvement in strength is $0.0015^2+0.0012^2=1.5625$; this is an improvement in strength of 56.25%.

As discussed above, the need for an improvement in strength of dicing blades exists since failure due to breakage, and most likely the result of fatigue, occurs at junction 30. A substantial part of the cause for such fatigue is eliminated by preparing hubs 12 by the above described grinding process instead of by using a lathe. The description below will be directed to a method for obtaining a tapered dicing blade in order to take advantage of the improvement in strength possible.

Figure 14:
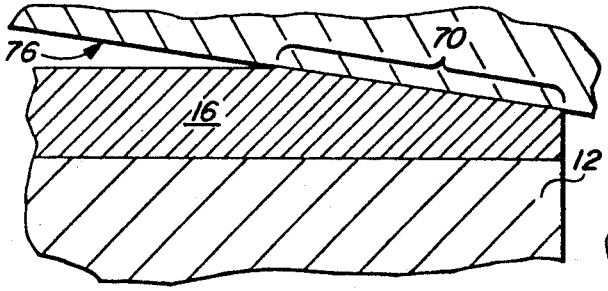
FIG. 14 illustrates apparatus for grinding a taper in a dicing blade.
Figure 17:
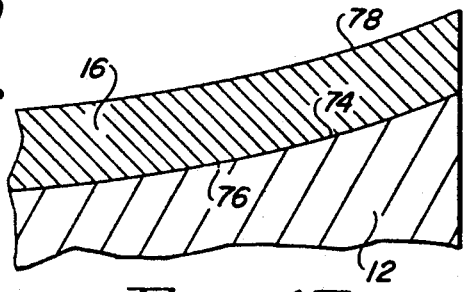
FIG. 17 illustrates in partial cross-section the dicing blade plated onto a concave surfaced hub.

The easiest way in which to obtain a taper for section 70 of dicing blade 16 is shown in FIG. 14. Herein a grinding wheel 76 is set at an angle with respect to radials of hub 12 and dicing blade 16. It may be pointed out that this grinding operation is performed prior to removal of annular portion 20 of hub 12 adjacent section 70 to be developed into the dicing blade (note FIGS. 2 an 3). This procedure is feasible but would require extremely accurate apparatus for maintaining grinding wheel 76 at a precise angle and yet permit adjustment of the angle to accommodate different requirements of the users of the dicing saw blades. Moreover, this process does not readily lend itself to high production, high accuracy and low cost requirements.

Figure 15:
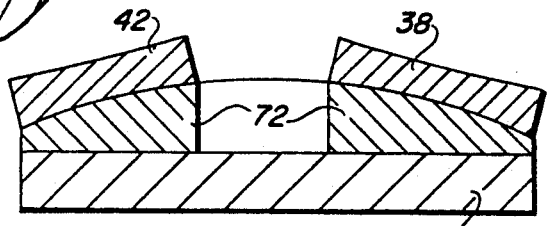
FIG. 15 illustrates apparatus for providing spherical convex surface to a backing plate.
Figure 11:
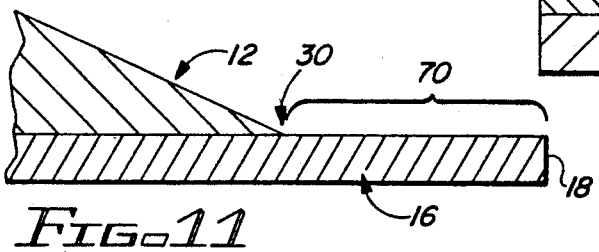
FIG. 11 illustrates in partial cross-section the configuration of the dicing blade attached to the hub of a dicing saw blade.

By modifying a standard lapping machine, such as illustrated in FIG. 6, the dicing blade may be readily single or double tapered with straight or curved taper or a single or double sides reverse taper may be effected. As shown in FIG. 15, backing plate 36 of a conventional lapping machine is ground with truing rings 38,42 in combination with a grinding medium 72 to develop a spherical section. The spherical section may be convex or concave, depending upon the action of the truing rings. The degree of spherical convexity or concavity of the grinding table can be controlled very precisely by the proper positioning of the truing rings.

Figure 16:
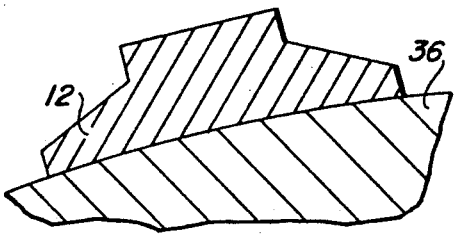
FIG. 16 illustrates grinding of a concave surface in the hub of a dicing saw blade.
Figure 13:
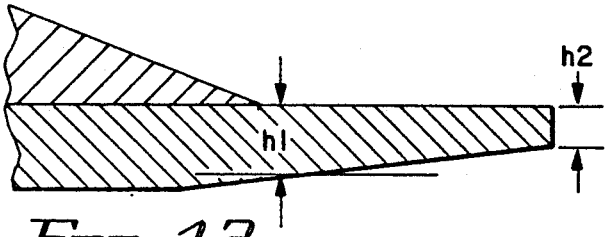
FIG. 13 illustrates in partial cross-section a tapered dicing blade.

As shown in FIG. 16, hub 12, placed upon convexly ground grinding table 36 will have a concave surface 74 formed therein prior to plating of the dicing blade. Dicing blade 16 plated upon concave surface 74 of hub 12, side 76 of the dicing blade will be curved equivalent to the corresponding curvature of surface 74. Additionally, opposed side 78 of the dicing blade will be similarly curved as a result of the essentially uniform thickness of the dicing blade resulting from the plating process. It may be noted that since concave surface 74 is ground, rather than cut on a lathe, it will have a smoothness sufficient to avoid the serious problems attendant hills and valleys in the dicing blade, as discussed above.

Figure 12A:
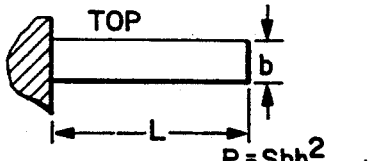
FIGS. 12*a* and 12*b* illustrate constant thickness and tapered cantilevered beams along with the formula for calculating the strength of a cantilevered beam.
Figure 12B:
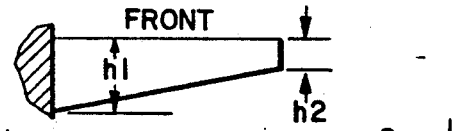
Figure 18:
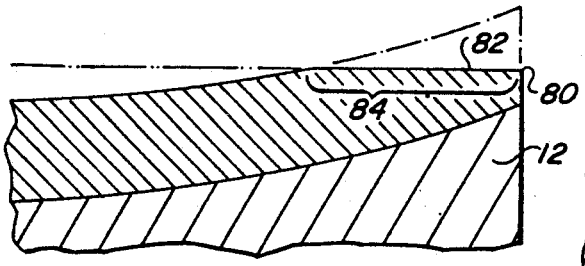
FIG. 18 illustrates apparatus for tapering a dicing blade.
Figure 19:
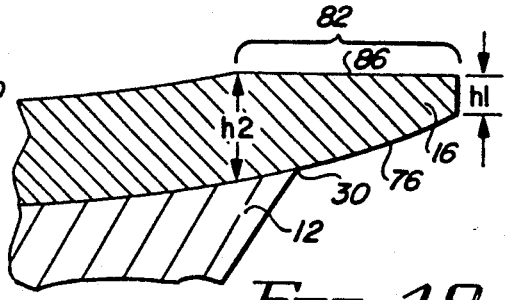
FIG. 19 illustrates a dual tapered dicing blade.
Figure 20:
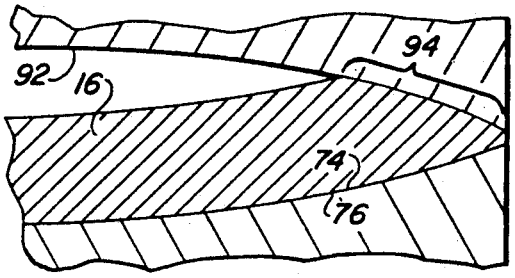
FIG. 20 illustrates a variant apparatus for tapering a dicing blade.
Figure 21:
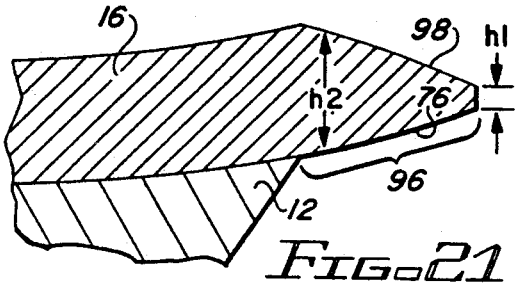
FIG. 21 illustrates a variant dual tapered dicing blade.

By placing hub 12 against a flat grinding plate 80, upwardly curved and extending annular segment 82 of dicing blade 16 will be ground away, as illustrated in FIG. 18. Upon such removal, section 84 of the dicing blade will be tapered in cross-section. Thereafter, the above discussed removal of annular portion 20 with a lathe and subsequent etching of hub 12 will expose curved side 76 of dicing blade 16. By the operation just described, surface 86 define by section 82 is a straight taper while surface 76 extending radially outwardly from junction 30 is curved. As discussed above with respect to FIGS. 12*a* and 12*b* and the mathematical computations, the strength of dicing blade 16 has been increased substantially and as a function of the difference in thickness between $h_1$ and $h_2$.

To obtain opposed curved tapered surfaces for dicing blade 16, a grinding wheel 90 having a concave grinding surface 92 may be employed in place of planar grinding plate 80. This curved surface will produce a radially curved section 94 on surface 78 of the dicing blade. Upon removal of the annular portion (20) of hub 12, section 96 of dicing blade 16 will be exposed. The exposed section has opposed tapered surfaces 76 and 98. The increase in strength is again a function of the difference between $h_1$ and $h_2$, as discussed above.

During cutting by a dicing saw blade, cutting edge 18 of dicing blade 16 performs the primary cutting function. However, the opposed sides of the dicing blade also perform a cutting or at least an abrading function as a result of the slightest wobble or axially oriented displacement of the hub. Depending upon the degree of cutting or abrading by the opposed sides, the width of the kerf will be increased. Furthermore, chips of the wafer may be removed. The contact with the opposed sides of dicing blade will also be a drag upon rotation of the dicing saw blade. The probability and extent of such contact can be essentially eliminated by undercutting the exposed annular section of the dicing blade.

Figure 22:
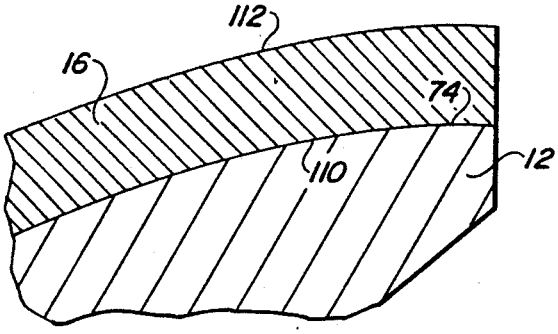
FIG. 22 illustrates a step in developing a reverse tapered dicing blade.
Figure 23:
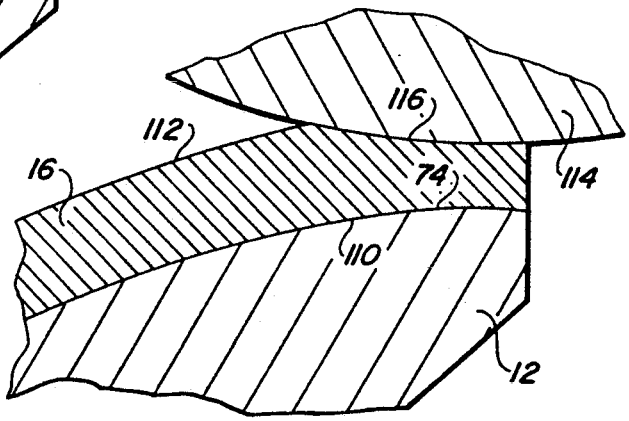
FIG. 23 illustrates a step for completing a reverse taper in a dicing blade.
Figure 24:
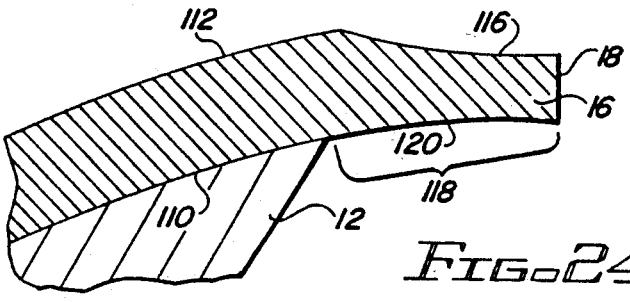
FIG. 24 illustrates in partial cross-section a dicing blade having a reverse taper and opposed sides.

Referring jointly to FIGS. 22, 23 and 24 there will be described a process for undercutting the exposed segment of a dicing blade. Surface 74 of hub 12 is ground upon a concave surface of a grinding table (instead of the convex surface shown in FIG. 16). Accordingly, surface 74 will be spherically convex. Upon electroplating dicing blade 16 on an annular segment of surface 74, surface 110 of the dicing blade will be concave and opposed surface 112 will be convex with both surfaces being essentially curvilinearly parallel. By grinding surface 112 of dicing blade 16 with a convex grinding table 114 an annular depression 116 will be formed in convex surface 112 of dicing blade 16. Upon removal of the annular portion (20) of hub 12 to form annular section 118 of dicing blade 16, it will be noted that the portion of concave surface 110 commensurate with section 118 will be in the nature of an annular depression 120. The combination of annular depressions 116 and 120 jointly provide a reverse taper to section 118 of the dicing blade. Thereby, the kerf of the cut to be made in a wafer is primarily, if not solely, defined by the width of cutting edge 18.

While the principles of the invention have now been made clear in an illustrative embodiment, there will be immediately obvious to those skilled in the art many modifications of structure, arrangement, proportions, elements, materials and components used in the practice of the invention which are particularly adapted for specific environments and operating requirements without departing from those principles.

We claim:

1. A method for removing hills and valleys from a face of a hub resulting from turning the face of the hub on a lathe, which hub comprises a back surface of a diameter less than the diameter of the face and a further surface disposed about the axis of rotation of the hub and interconnecting the face and the back surface, and for obtaining parallelism between the face and the back surface of the hub prior to plating a dicing blade on the face of the hub to form a dicing saw blade, said method comprising the steps of:

a) grinding simultaneously the whole area of one of the face and back surface of the hub with a flat grinding table;

b) further grinding simultaneously the whole area of the other of the face and back surface of the hub with the flat grinding table;

c) during exercise of said step of further grinding applying a force upon the one of the face and back surface ground during said step of grinding with a surface of a backing plate, which backing plate surface is parallel with the flat grinding table, to obtain parallelism between the face and the back surface.

2. The method as set forth in claim 1 including repeating said grinding step after completion of said further grinding steps.

3. The method as set forth in claim 2 including the step of further applying a force upon the other of the face and back surface with the surface of the backing plate during exercise of said step of repeating said grinding step.

4. A hub for a dicing saw blade, which hub comprises a face, a back surface of a lesser diameter than the face and a further surface disposed about the axis of rotation of the hub and interconnecting the face and the back surface, and fabricated in part in accordance with a method comprising:

a) grinding simultaneously the complete face of the hub with a grinding table;

b) inverting the hub upon the grinding table to place the back surface of the hub adjacent the grinding table;

c) applying a force upon the face of the hub with a surface of a backing plate to urge the back surface against the grinding plate, which backing plate surface is parallel with the grinding surface of the grinding plate;

d) further grinding simultaneously the complete back surface with the grinding plate;

e) reinverting the hub upon the grinding plate to place the face of the hub upon the grinding surface of the grinding table;

f) regrinding simultaneously the complete face of the hub with the grinding table.

5. The method as set forth in claim 1 including the step of further applying a force upon the other of the face and back surface during exercise of said step of grinding.

6. A hub having a face, a back surface of lesser diameter than the face and a conical section interconnecting the face and the back surface, for supporting a membrane serving as the cutting edge of a dicing blade, which hub is fabricated in part by a method comprising the steps of:

a) grinding the whole area of one of the face and the back surface with a grinding table;

b) inverting the hub upon the grinding table;

c) locating a surface of a backing plate adjacent the one of the face and the back surface after completion of said step of inverting to urge the hub toward the grinding table, which backing plate surface is parallel with the grinding table; and d) further grinding the other of the face and the back surface in response to the force exerted by the backing plate to maintain the one of the face and the back surface parallel with the grinding table.

7. The method as set forth in claim 5 including the step of further locating the backing plate surface adjacent the other of the face and the back surface during said step of grinding to grind a flat surface upon the selected one of the face and the back surface.

* * * * *